United States Patent [19]

Winans

[11] 4,285,443

[45] Aug. 25, 1981

[54] CARD DISPENSING MODULE

[76] Inventor: Eugene P. Winans, 7795 E. Napa Pl., Denver, Colo. 80237

[21] Appl. No.: 114,055

[22] Filed: Jan. 21, 1980

Related U.S. Application Data

[63] Continuation-in-part of Ser. No. 892,182, Mar. 31, 1978, Pat. No. 4,209,108.

[51] Int. Cl.[3] ..... G07F 11/28

[52] U.S. Cl. ..... 221/155; 221/232; 221/285; 271/138

[58] Field of Search ..... 221/155, 198, 232, 258, 221/6, 285; 194/1 R, 12; 271/131-144; 312/60, 61, 71, 118

[56] References Cited

U.S. PATENT DOCUMENTS

| | | | |
|---|---|---|---|
| 744,673 | 11/1903 | Balsley | 221/232 X |
| 1,064,941 | 6/1913 | Thompson | 221/155 X |
| 1,616,251 | 2/1927 | Bookout | 221/232 X |
| 2,305,342 | 12/1942 | Fry | 221/130 X |
| 2,382,576 | 8/1945 | Pease | 221/155 |
| 2,444,747 | 7/1948 | Niewoehner | 221/232 X |
| 3,722,745 | 3/1973 | Gushi et al. | 221/232 X |
| 3,753,514 | 8/1973 | Naguet | 221/129 |

*Primary Examiner*—F. J. Bartuska

[57] ABSTRACT

A complete advertising and card dispensing module for insertion into a housing, having electrical connections for the module, includes a front face, for securing to the housing by a key lock for removing the entire module, with the front face having an advertising window and a card display window, and a push button switch for actuating a single card ejector. The card ejector includes a housing for a stack of cards with a smooth floor member with a card width and thickness card pusher gliding on the smooth floor to push a single card out an adjustable slot adjusted to the thickness of the individual card. The smooth floor being mounted generally horizontally but at a slight angle toward the slot. A solenoid actuator moves the card ejector from a position at the rear of the stack of cards to a position to push a card so as to partially extend out the slot for manual retrieve.

7 Claims, 7 Drawing Figures

FIG. 1
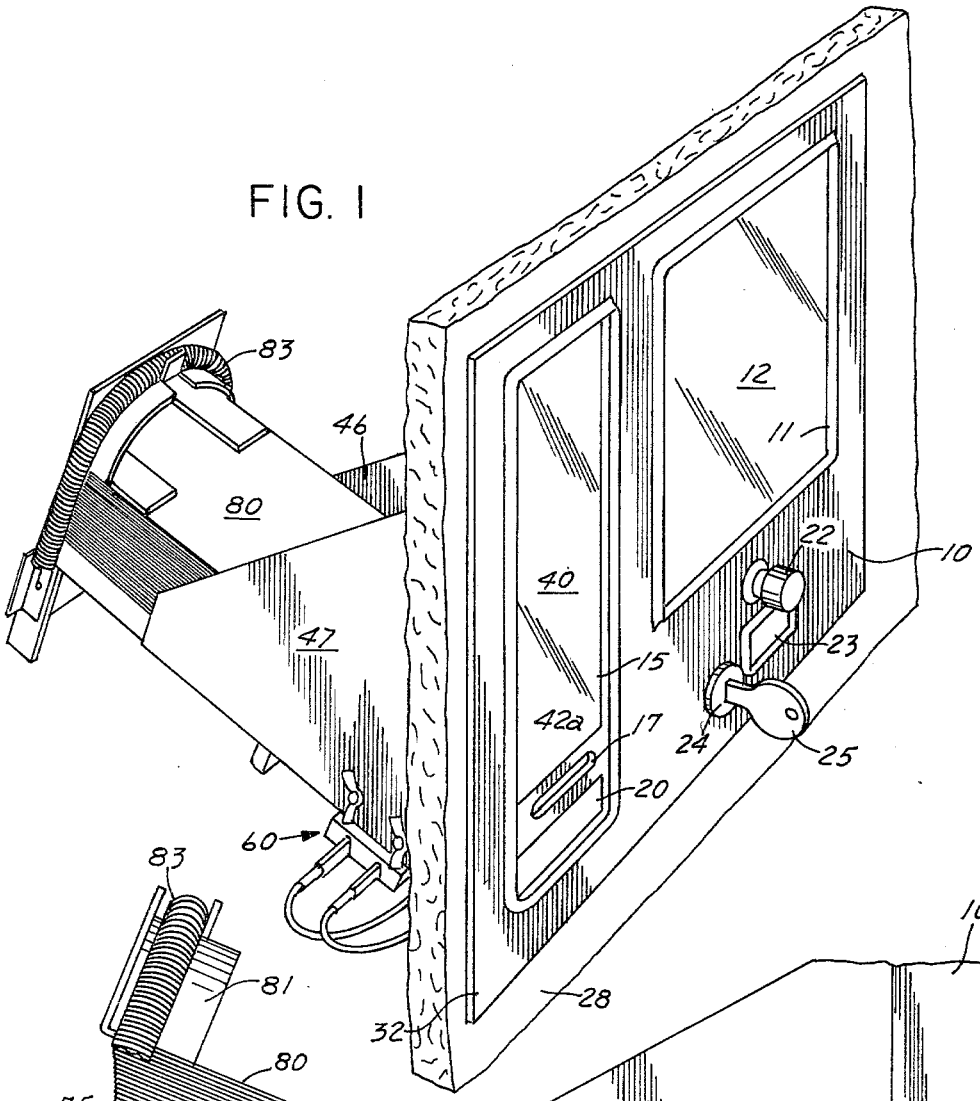
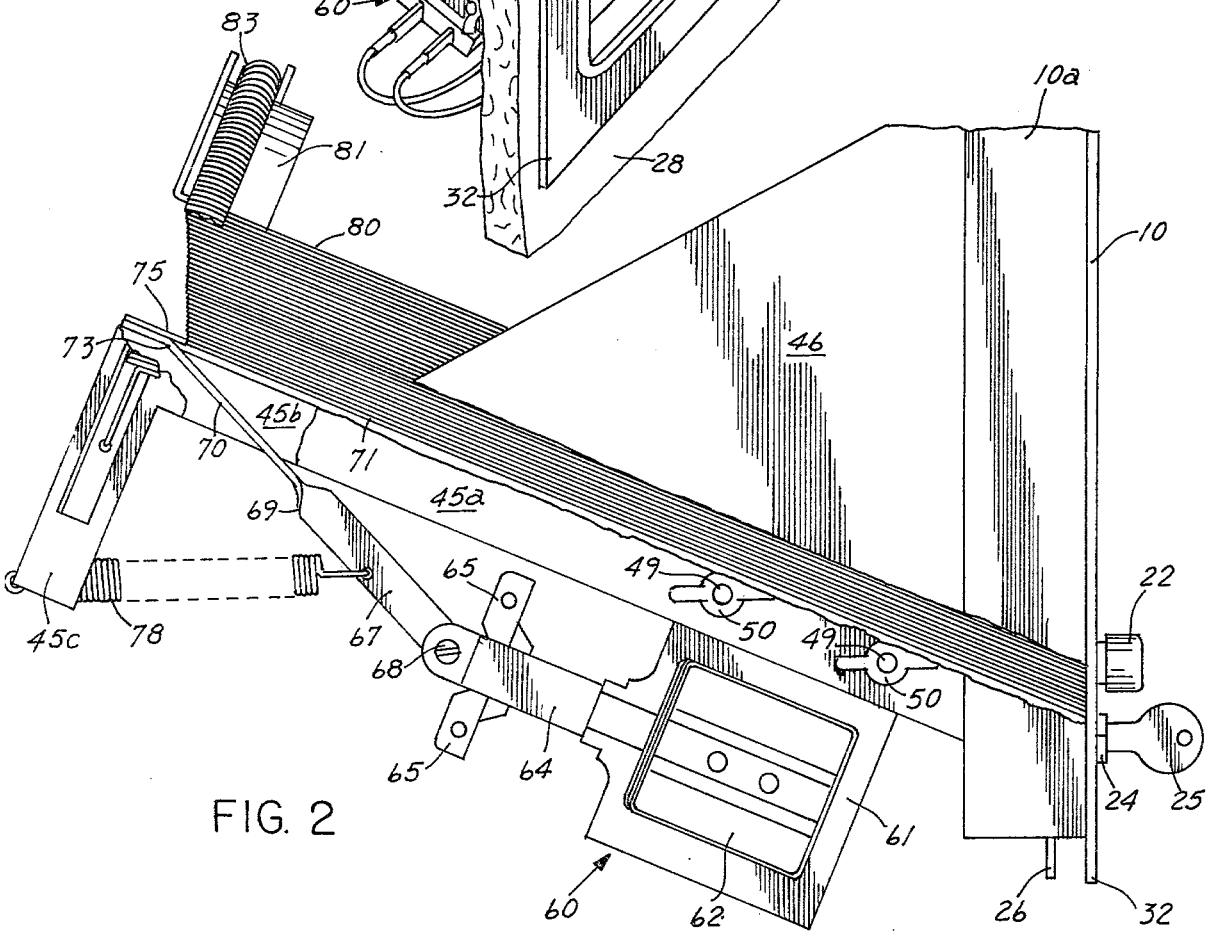
FIG. 2

CARD DISPENSING MODULE

This application is a continuation in part of application Ser. No. 892,182 filed Mar. 31, 1978 titled, "Display Assembly With Card Ejector" now U.S. Pat. No. 4,209,108.

The present invention is directed to a complete module for advertising copy and displaying of advertising cards (usually discount cards for goods or services) and/or brochures, and an ejector for such cards from a supply stack, ready for mounting in a housing.

It is generally conceded that advertising is more effective when a potential recipient of the advertising is given an incentive to use the goods or the services of the advertiser. Incentives such as discount coupons tend to produce a higher use of such goods and services or at least to draw potential customers to the advertiser's place of business. Coupons may be placed in newspapers and magazines, but this circulates some that are used, but many times more coupons are passed over and not used. An ideal situation is to provide discount coupons in only the hands of an actual user of the goods or services, as for example, at the location of use or potential use of the goods or services. It is also generally conceded promotional advertising is effective when an advertiser can tell a complete story in picture form together with printed information in the form of a folded brochure or information piece. Present means of distribution of this type of printed material is by an open slot rack type of display that permits such brochures to be taken severally when reached for such material thereby creating a waste factor. Present means of display and distribution of this material allows for it to be openly exposed to the elements of constant handling thereby creating soiled conditions, and/or damage to the printed matter. And, in addition the printed material is often taken from one slot, examined, then put back in another adjoining slot thereby disorienting the display. An ideal situation is to supply brochures singularly, when having them enclosed in a housing display to protect them from the elements and disorientation, and yet, have the brochures and such similar material individually displayed at the location.

THE PRESENT INVENTION

The present invention provides a complete module for the advertising of and the dispensing of a discount card or brochure to a reader of the advertising. The unit is complete, ready to be inserted into a housing (a hole in a wall, a container for one or more, etc.) and attached to an electric power line. The unit is easily filled and serviced as it has a key lock securing mechanism to the housing, permitting fast and easy withdrawal of the unit.

OBJECTS AND ADVANTAGES OF THE INVENTION

It is, therefore, among the objects and advantages of the invention to provide a complete modular unit for advertising, displaying and dispensing printed materials pertaining to the advertising.

Another object of the invention is to provide a complete modular unit for easy mounting in a housing ready for hookup to an electrical power line for operation, and which is easily removed from the housing.

Another object of the invention is to provide a complete modular unit that is lightweight and self dependent to permit mounting and use at various angles, and in various types of housing.

An additional object of the invention is to provide a versatile card dispensing unit adapted to different thickness of cards to be dispensed, and is arranged with a card pusher that pushes a single card by sliding it out from the bottom of a stack of cards without disrupting the stack of cards.

Another object of the invention is to provide an advertising display and an indicator for the quantity of cards left for dispensing.

These and other objects and advantages of the invention may be ascertained from the following description and appended drawings.

GENERAL DESCRIPTION OF THE ILLUSTRATIONS

FIG. 1 is cut away, perspective of a dispenser of the invention showing its mounting in a wall of a housing.

FIG. 2 is a partially cut away side elevational view of a dispenser according to the invention.

SPECIFIC DESCRIPTION OF THE DRAWINGS

Figure 3:
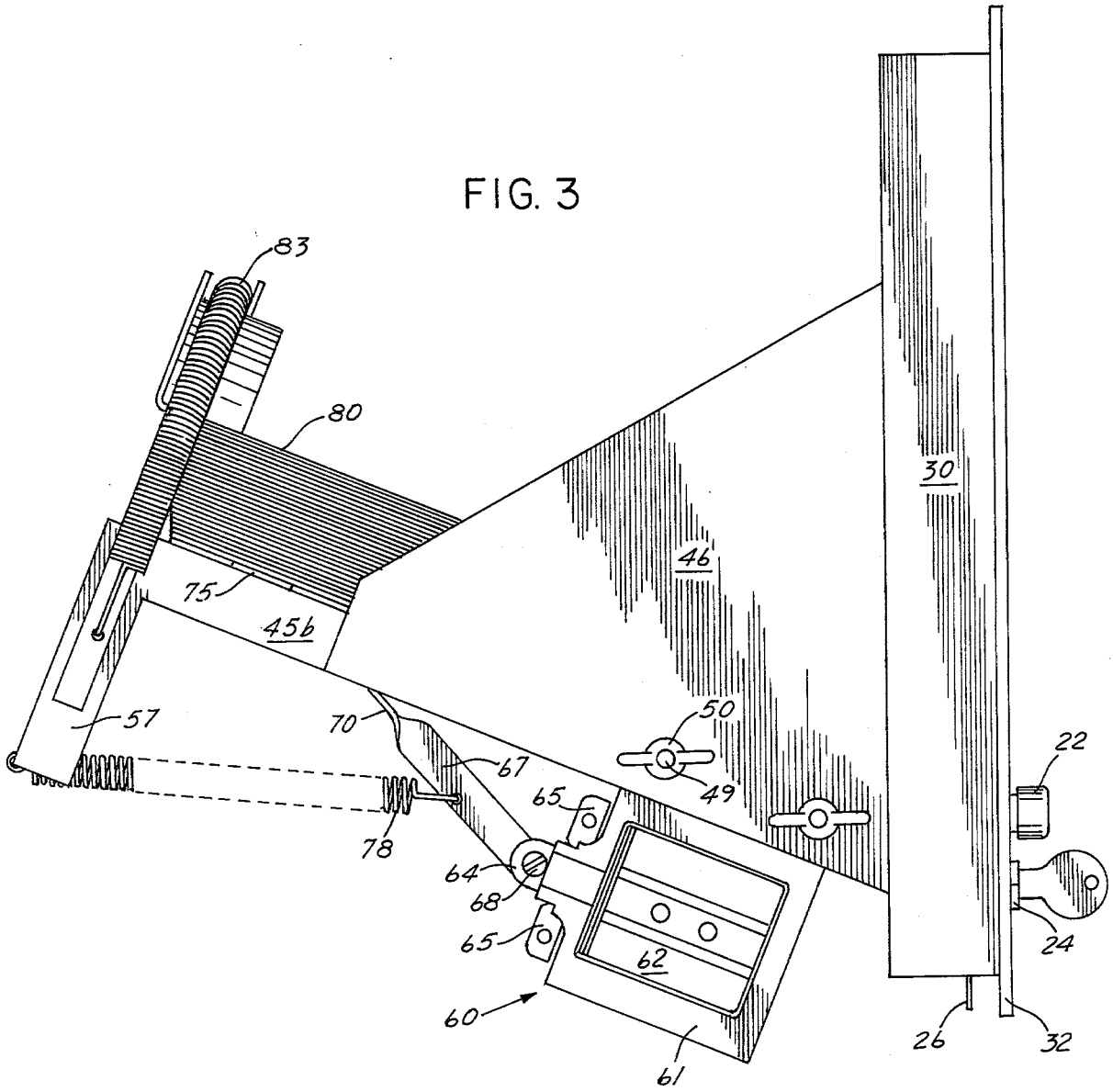
FIG. 3 is a side elevation of the device of FIG. 1 in card dispensing position, without the housing wall.
Figure 4:
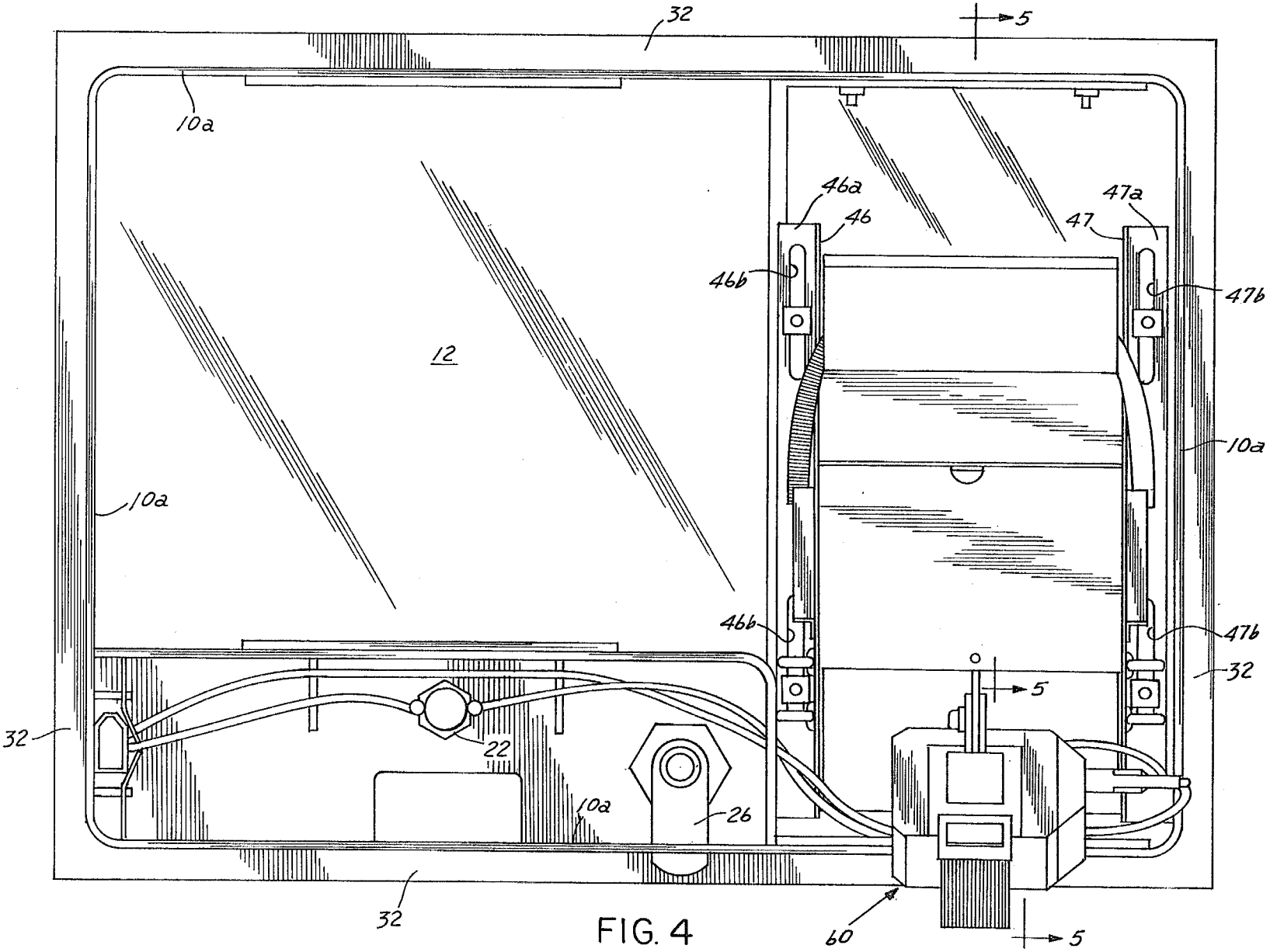
FIG. 4 is a rear, elevational view of the advertising and card supply and dispensing mechanism according to the invention.
Figure 6:
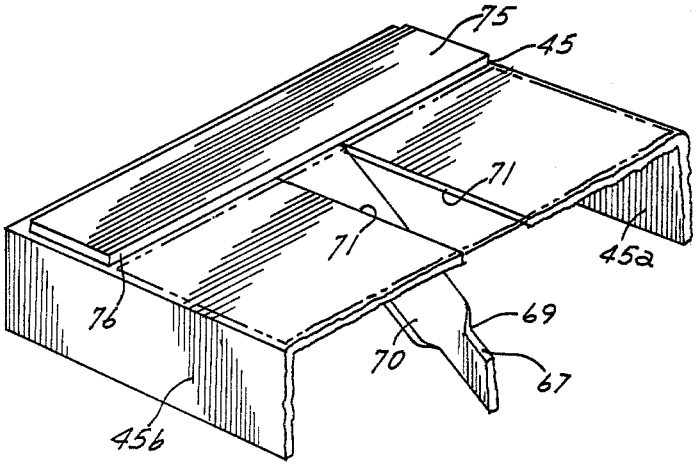
FIG. 6 is a perspective detail of the card pusher and actuating arm according to the invention.
Figure 5:
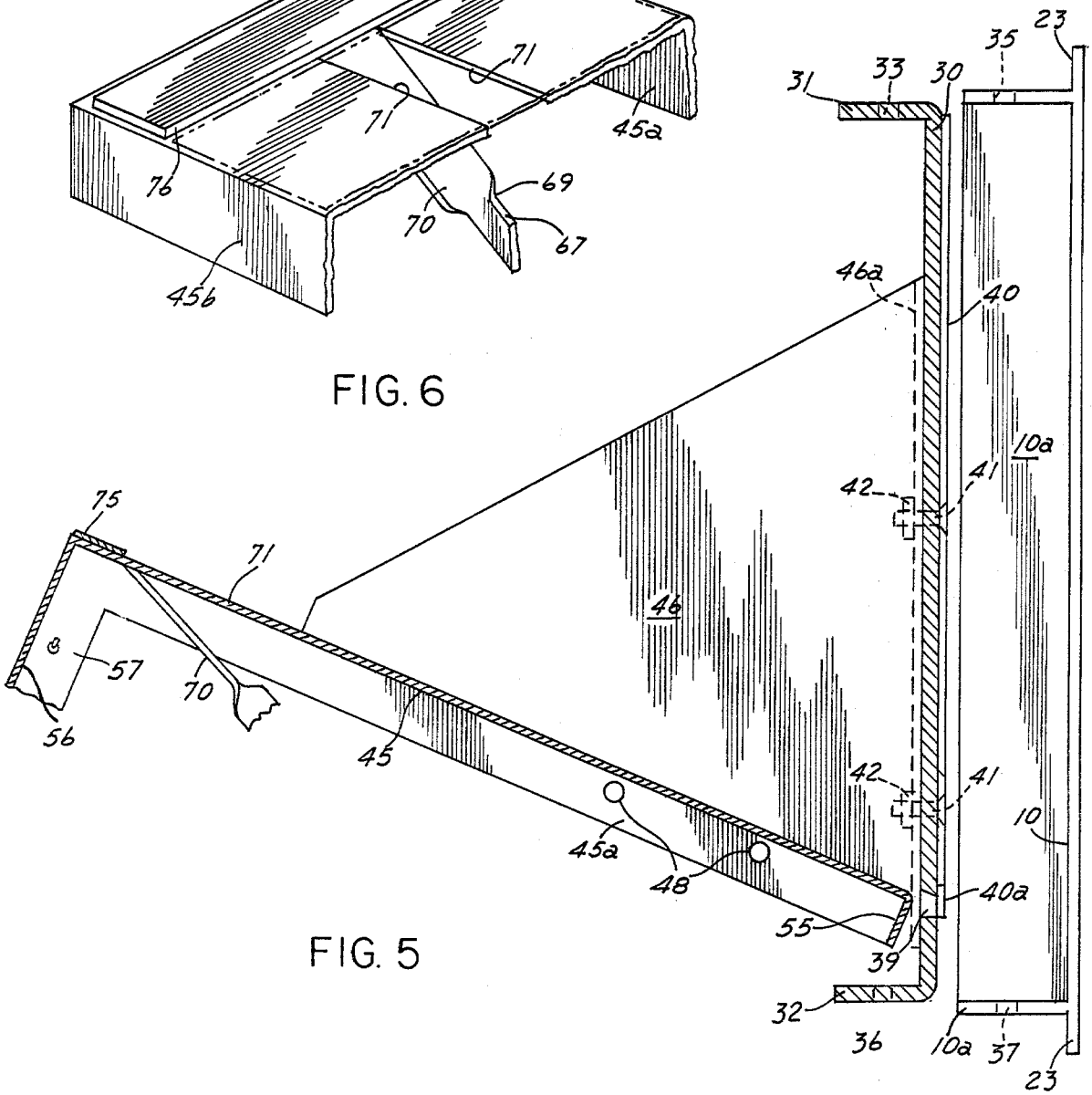
FIG. 5 is side elevation section through 5—5, FIG. 4 of the frame of the card dispenser, in exploded positioning.

The modification selected for purposes of illustration in FIGS. 1-7, includes a front, face plate 10, arranged for mounting in an opening of a housing, having an advertising cut out 11 covered by a transparent or translucent plate 12 mounted on the rear of the plate. Advertising copy may be placed on the rear side of the "window+ or plate 12 for viewing from the outside. By using translucent sheets with the advertising, a light to the rear of the window illuminates through the sheet for an effective display. A second, smaller, opening 15 is formed in the face plate, and it is arranged to be closed by a transparent covering 40 for the display of a sample of the cards which are dispensed by the unit. A low supply opening or window 17 is positioned below the opening 15. This window is arranged to be covered (on the rear) by a transparent red (or other discernable color) covering portion 40*a*. Usually the transparent window 40 extends over opening 17 and the colored portion 40*a* is at the bottom of the covering 40, so that when the card stack in the unit is depleted below the top of the opening 17, light from the rear shines through the colored covering visually indicating the low supply. A card dispensing slot or slit 20 is formed below the low supply opening 17, to dispense cards, as explained below.

A push button switch 22 actuates a card dispenser, explained below, and a direction label 23 below the button, provides directions for operation of the card dispenser. A key actuated lock 24 (by key 25) turns locking lever 26 (shown in FIG. 2) into a lock slot (not shown) in the housing wall in which the module is mounted, such as wall 28 of FIG. 1.

The front plate 10 includes a continuous depending, rearwardly directed box flange 10*a*, of a size to fit in the opening in the wall, and when locked, supports the unit in the wall. The front plate provides peripheral edges 32, in the plane of the plate, completely around the box flange 30 for face engagement with the wall, limiting movement of the unit through the opening by forming an effective stop. The edges, also, blind the opening in the wall.

A unitized card dispensing unit is mounted in a portion of the front plate, in position to push a single card (for a single push of the actuating button) partially out of the slot 17. The mounting means for the dispensing unit includes a dispenser front mounting planar plate 30 (FIG. 5) having normal, rearwardly directed top and bottom flanges 31 and 32. This plate, which is a solid plate, fits in the right side of the box flange of the front plate over opening 15, and is secured therein by bolts and nuts (not shown) through mating top holes 33 in flange 31 of plate 30 and hole 35 in the top of box flange 10*a*. Similarly, holes 36 and 37 align for bolts nuts (not shown) at the bottom. Preferably, a pair of bolts at the top and a pair at the bottom effectively hold the dispensing unit to the plate 10, but permits easy and fast removal and replacement of the card dispensing assembly. A card dispensing slot 39 is formed adjacent the lower end of the plate 30 having a sloped upper surface in the slot. The slot 39, when mounted, communicates with slit 17. A transparent card holder 40, is secured by bolts 41 and nuts 42 (two on each side) to the plate 30. A sample card (of the stack of cards) may be positioned between the plate 30 and the transparent covering 40 so as to be exposed to the opening 15 in the plate 10.

A smooth, card supply, holding base plate 45 is secured to plate 30 by side plates 46 and 47, which have outwardly directed, normal flanges 46*a* and 47*a* respectively, positioned against plate 30 and held by the bolt 41 and nut 42 sets on each side. The side's flanges 46*a* and 47*a* are provided with elongate holes 46*b* and 47*b* (FIG. 4) for adjustment of the height of the base plate 45 in relation to the slot 39. The plate 45 includes downwardly depending, side flanges 45*a* and 45*b*, having a pair of holes 48, in alignment, and a pair of bolts 49, with wing nuts 50, hold the side plates to the base. The plate 45 is mounted at an angle of from 55°–80° from the plane of the front plate, and preferably 65°–75°.

The base plate 45 includes a forward end 55 bent at about a right angle and positioned adjacent slot 39, so as to force an ejected card into a slight bend downward as it is pushed through the slot 39 from the stack. An opposite, rear end of the base plate 45*a* includes flange 56, with normal side flanges 57 to strengthen the base plate. The base plate and flanges are usually relatively thin stainless steel. The flanges 57 on the portion 56 provide an anchor for a card stack hold-down spring, explained below. The bolts 49 which extend through the side flanges of the base plate from side to side, also, provide securing means for a solenoid actuator, shown generally by numeral 60.

The solenoid includes a frame 61, which includes bolt holes (not shown) for passing the holding bolts 49. The conventional solenoid includes a coil 62 and a magnetizable piston or armature 64. The armature includes stop 65 (on opposite sides) which impinge on the frame to prevent further movement of the armature into the solenoid on activation. An actuating arm 67 is pivotally secured to the armature 64 by pivot pin 68. The actuating arm is twisted 90° so as to be turned at a right angle at position 69 to provide a flat surface 70 in the plane of the base 45 of the card holder. A slot 71, of a width to reciprocably accommodate the flat blade 70 without binding, is formed in the base 45. The slot extends from rear edge through the flange 56 a distance along the base plate to accommodate the movement of the activating arm. The blade 70 is slightly bent at 73, and is attached, as by welding, flush against the card pusher plate 75. The pusher 75 is substantially the width of the base plate 45, and is the same thickness as one of the cards stacked in the supply. The top surface of the pusher 75 is smooth, without any sharp corners or burrs. The smoothness is highly important as the front edge 76 of the pusher engages a card, pushing the card forward under the stack of cards, so that it has its front edge extending out from under the stack of cards and out the slit 17. At the same time, of course, the pusher enters under the stack during the pushing, contacting the bottom of next adjacent card. Any burrs or roughness on the pusher bar could hang up the next adjacent card in the stack. A coil spring 78 is secured to the right angle flange section 56 of the base plate 45 and to the arm 67, at an angle so as to pull down on the arm 67, forcing the plate 75 into close contact with the plate 45. Since the pusher bar runs on the plate 45, both must be smooth for proper, free movement. The pusher is approximately the width of the card and approximately the width of the distance between side walls, which insures straight pushing on the card without canting the card against the side plates or the sides of the slot. This configuration insures that only the bottom-most card will be pushed out the slot without binding. The spring insures that the pusher will be returned to a position at the rear of the bottom card, out of contact with the bottom card, in position to contact the edge of the next card, which is now the bottom card.

The cards are pressed tightly against the base plate 45 and against the front plate 30 by a relatively heavy presser plate 80, having a coil spring holding assembly 81. The holding assembly curves up and across the rear end of the plate 80. A coil spring 83 is secured to each side of the plate 45 on rear flanges 57 and over the holding assembly 81. The cards and the plate 80 lie flat and are parallel with the plate 45. The flanges 57 are perpendicular to the plate holding the spring perpendicular to the plate tending to pull the plate 80 down and against the front plate 30. The base plate is at an angle to front plate 30, so that the ends of the cards in the stack are against the plate 30 at the same angle. The presser plate 80, under spring pressure, presses the cards down and against the front plate 30. This insures that the bottom card is in position to be contacted by the pusher and is pushed out from the bottom of the stack through the slot. The combination of the width and thickness of the pusher and the spring holding it against base plate insures that the cards are pushed straight along the base plate 45 through the slot. This is highly important as the solenoid action is extremely fast, and a canted card or pusher bar might fail to eject a card, causing a machine malfunction.

Figure 7:
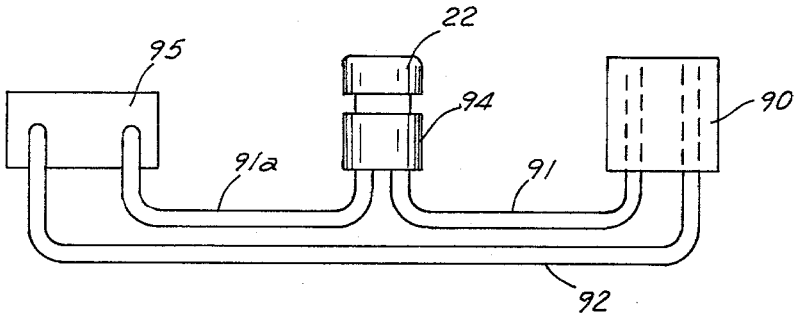
FIG. 7 is a schematic view of an electric circuit for the solenoid actuator of the card dispenser.

The unit is prewired so that it is easily and quickly "plugged" into an electric cord as by a male two prong plug or a female receptacle. As shown in FIG. 7, a two opening, female receptacle 90, in position to be attached to an existing plug adjacent the wall opening which holds the unit, has two wires 91 and 92 secured to the contacts in the receptacle holes. The wires are in electrical communication with contacts or conductors (not shown) in the openings of the plug 90. Lead 91 extends to one side of the switch of the push button, spring loaded (off) switch 94, and lead 91*a* extends from the other side of the switch to one end of solenoid coil 95. The conductor 92 is secured to the other end of coil 95. One lead is hot and the other is ground, completing the circuit. On pushing the button, the circuit is closed, charging the coil.

The unit is prepared for operation by removing it from the opening, using the key 25. The presser plate is removed and stack of cards placed on the base plate 45, and pushed against the front plate so that all the cards abut the front plate 30. The presser plate is replaced, and with the spring 83 in place, the cards are pressed down onto plate 45 and forward against the front plate. The unit is replaced in the housing opening, and the key turns the lock lever into holding position. The electrical connection is made prior to inserting the unit in the opening. With the electricity on, the button may be pushed to actuate the solenoid and dispense a single card. A light in the housing provides illumination for the advertising.

The base plate 45 (as well as the transparent plate 40) is positioned on the front plate 30, by means of the bolt-nut sets 41–42, so as to permit the edge of a card to enter slot 39, but the positioning gives the card a slight bend downwardly. This stops the next card from being dispensed along with bottom card, as its front edge impinges on the front wall. On a low level of cards, light from the housing gradually shines through the colored cover in the opening 17 showing the condition of the supply.

What is claimed is:

1. A modular dispenser for cards and the like comprising:

(a) face plate means arranged for attachment in an opening in a housing wall, and having depending flanges from one side forming a walled support, and said face plate means including one large advertising window and one card display smaller window, and a card eject slit;

(b) a support frame with depending upper and lower flanges arranged to seat in a portion of said walled support and be secured therein over said smaller window;

(c) side wall means adjustably secured to said support frame;

(d) card support base means sloped at an angle to said support frame, secured to said side wall means and arranged to seat adjacent said card eject slit;

(e) said card support base means being smooth for unrestricted card travel thereon, and having a central slot in the end opposite said card eject slit;

(f) a card pusher bar, of not more than the thickness of the cards to be dispensed, having a length of about the width of said support base means between said side wall means mounted on said support base means and arranged for free, uninhibited travel on said support base means between said side wall means;

(g) solenoid means mounted beneath said sloped card support base means;

(h) connector means extending through said central slot and connected between said solenoid means and said card pusher bar for moving said pusher bar to contact a card and push a portion thereof out said card eject slit;

(i) means for actuating said solenoid means;

(j) spring means secured to said support base means and to said connector means for biasing said pusher bar onto said card support base means and for returning said pusher bar to a position out of contact with a stack of cards on said support base means; and (k) card stack presser means, pressing said stack of cards on said card support base means and toward said support frame.

2. A modular dispenser for cards and the like according to claim 1, wherein said card support base means is sloped at an angle of from 55° to 80° to said frame.

3. A modular dispenser for cards and the like according to claim 2 wherein said angle is from 65° to 75°.

4. A modular dispenser for cards and the like according to claim 1 wherein said support frame covers said smaller window and includes means to display one of the cards being dispensed in said smaller window.

5. A modular dispenser for cards and the like according to claim 1 wherein said connector means is a bar with a width for free movement along said central slot, and being secured to the bottom said pusher bar flat across its width.

6. A modular dispenser for cards and the like according to claim 1 wherein said walled support is continuous.

7. A modular dispenser for cards and the like according to claim 1 being further characterized by lock means for securing said unit in an opening in a housing wall.

* * * * *